US005575323A

United States Patent [19]

Smuckler

[11] Patent Number: 5,575,323

[45] Date of Patent: Nov. 19, 1996

[54] POSITIVE CLOSURE APPARATUS FOR VERTICAL BLIND TRACK BY INTERNAL DRIVE GEAR CONTROL

[76] Inventor: Lawrence Smuckler, P.O. Box 616, Capon Bridge, W. Va. 26711-0616

[21] Appl. No.: 382,176

[22] Filed: Feb. 1, 1995

[51] Int. Cl.[6] ..... E06B 9/38

[52] U.S. Cl. ..... 160/177; 74/411.5; 74/462; 74/530; 475/344

[58] Field of Search ..... 160/176.1 V, 177 V, 160/168.1 V, 173 V, 172 V, 173 V, 900; 74/411.5, 462, 530; 475/344, 345, 349

[56] References Cited

U.S. PATENT DOCUMENTS

| | | | |
|---|---|---|---|
| 3,878,877 | 4/1975 | Bruneau et al. | 160/168.1 V |
| 3,996,988 | 12/1976 | de Wit | 160/168.1 V |
| 4,224,973 | 9/1980 | Hugin | 160/176.1 V X |
| 4,332,288 | 6/1982 | Frentzel et al. | 160/168.1 V X |
| 4,657,060 | 4/1987 | Kaucic | 160/176.1 V X |
| 4,834,163 | 5/1989 | Dickstein | 160/177 V X |
| 4,944,196 | 7/1990 | Rivin | 74/462 X |

*Primary Examiner*—David M. Purol
*Attorney, Agent, or Firm*—Charles Brodsky

[57] ABSTRACT

In a vertical blind track of the type incorporating a sprocket gear within an end control housing to rotate a fluted pinion gear and vanes carried thereby under action of a pull-chain, and wherein the end control housing includes a first gear and a pair of second gears, one of which is driven by the sprocket gear when rotated, the apparatus of the invention secures the vanes in closed position, against inadvertent "bounce back" to a partially opened position, by utilizing the sprocket gear to effect rotation between the first gear and the pair of second gears, but with a filled recess between a pair of adjacent teeth on the first gear to prevent meshing with the second gears, and causing a binding of the rotating mechanism at a predetermined point which defines the closed position of the vanes.

10 Claims, 3 Drawing Sheets

POSITIVE CLOSURE APPARATUS FOR VERTICAL BLIND TRACK BY INTERNAL DRIVE GEAR CONTROL

FIELD OF THE INVENTION

This invention relates to the installation of vertical blinds and, more particularly, to a vertical blind track modification which is both inexpensive to manufacture and install, yet provides significant improvements in overall operation.

BACKGROUND OF THE INVENTION

In my U.S. Pat. No. 5,090,467, issued on Feb. 5, 1992, and entitled "Vertical Blind Track Protector", I described a new and improved vertical blind construction that automatically placed the vanes into their correct open position whenever a user desired to traverse the blind. As there set forth, if a user attempted to traverse the blind in the "vane closed" position, my described arrangement automatically rotated the vanes to the "vane open" position before the unit traversed. The track protector there shown thus operated to prevent the vanes of the blind from traversing in the closed position, and causing damage.

While the solution depicted in my U.S. Pat. No. 5,090,467 overcame one of the problems confronting the vertical blind industry, another problem continued to exist—that of "bounceback", or a refusal of the vanes to remain in a tightly closed position once so oriented by a user. As those involved in the art recognize, vanes (or louvers) have a tendency to open slightly by themselves—as when vertical blinds are hung over open windows or sliding doors, due to puffs of breeze, or accidentally jostling into them. Investigation has also shown that one cause for this can also be traced to the use of slightly twisted pinion rods in the track, or a twisting of the channel when installed on an uneven surface.

Analysis, furthermore, has shown that the smooth, direct rack and pinion-planetary gear rotation mechanism commonly employed in many modern vertical blind tracks also contributes to this "bounceback" problem. Typical to this are those arrangements described in U.S. Pat. Nos. 4,657,060 and 4,834,163—which utilize relatively high speed reducing drives which are very convenient to use but which are very susceptible to this problem. In fact, their conveniences have led to an increase in the popularity of vertical blinds with architects and consumers alike, who balance that out with their dislikes of the vane-opening problem.

Some manufacturers have attempted to avoid this "bounceback" by designing the drive and rotating mechanisms deliberately to have more friction on the planetary gears employed. For example, some accomplish that by allowing the gears to rub against the inside wall of the housing, while others include a restricting device consisting of a flat plate which increases the resistance of the gears. While such approaches make for tighter, more secure vane closure, they all require an increased force be applied in order to effect the rotation. Such harder "action" is quite noticeable, and many times disapproved—most frequently by users of large tracks with heavy load. Such approaches, additionally, have been observed to be too stiff in their operations to allow the vanes to completely return to the open position when traversed (to utilize the advantages of my vertical blind track protecting system), resulting in an increased drag on the traverse "action", and increase stress on the various components of the vertical track system.

A different type of approach to the problem is present in U.S. Pat. No. 4,122,884, which employs a worm and screw gear to transfer rotational forces from a pull-chain to the pinion rod. While the approach allows for very precise louver rotation and fairly tight closure, there is a definite lack of smoothness as is associated with the preferable planetary gear constructions, and introduces other problems of its own. For example, the automatic rotation of my U.S. Pat. No. 5,090,467 cannot be utilized because the worm gear is unable to work in reverse direction. That is, while the louver chain can rotate the worm gear to turn the pinion and suspended vanes, any attempt to turn the pinion directly or by means of traverse cord action on my track protector does not budge the gears.

Yet another approach of obtaining vertical blind vane control locking is set forth in U.S. Pat. No. 5,163,492. There, a device fastens to a wall surface near the actuating chain, and is so designed that beads on the chain can be engaged manually into locking slots in the device to prevent movement of the vanes. One disadvantage of such arrangement will be noted to be that the auto-rotation method patented by me cannot be utilized with the lock deployed in any position—attempts to traverse the blind when the vanes are in the locked closed position virtually guarantees track damage. Secondly, proper operation requires instruction in carrying out the procedure, and while fairly simple, any manual locking and unlocking of the chain is an inconvenient step. Thirdly, experience has shown that installers dislike doing anything more than they have to, and the teachings of this patent require that there be extra work for the installation. (This, along with the cost of the mounting hardware, adds to the price charged to the consumer.) Additionally, incorrect and/or inadequate installation of the lock has been found to result in damage to the lock, to the wall on which it is mounted, to the vertical blind track, and to the brackets supporting the track. Even when correctly installed, another disadvantage of this configuration is that the job still requires mounting holes to be drilled into a wall, molding, or jamb—which is objectionable to the user in many instances.

OBJECTS OF THE INVENTION

It is an object of the present invention, therefore, to provide a new and improved vertical blind closure apparatus which overcomes the limitations of the prior art.

It is another object of the invention to provide such apparatus while continuing to enable the auto-rotation feature of my afore-noted patent to be carried out.

It is another object of the invention to provide such positive closure apparatus in a construction which is able to operate with existing design manufactures.

SUMMARY OF THE INVENTION

As will become clear from the description that follows, the positive closure apparatus of the invention operates in a vertical blind track arrangement of the type which incorporates a sprocket gear within an end control housing to rotate a fluted pinion gear and the vanes carried thereby under action of a pull-chain. Two types of constructions of this nature have been widely employed. One is described in U.S. Pat. No. 4,657,060 (Kaucic) issued Apr. 14, 1987 entitled "Vertical Venetian Blind With Inline Drive". A second, U.S. Pat. No. 4,834,163 (Dickstein) issued May 30, 1989, entitled "Vertical Louver Assembly". One commonality in these two descriptions is that the end housing of each included a first gear and a pair of second gears—one of which was driven by the sprocket gear when rotated. As will be seen below, the positive closure apparatus of the present invention operates with either of these constructions.

More particularly, and as will be seen, the apparatus of the invention employs a filled recess between a pair of adjacent teeth on the first gear to present meshing with at least one of the pair of second gears at a predetermined point which defines the closed position of the vanes. That is, and as will be seen, filling the recess at least 5–10% of the cavity space between such pair of adjacent teeth binds the rotating mechanism at a preselected point so that the vanes are prevented from opening.

In a preferred embodiment of the invention, to be described, a second filled recess is employed—also at least 5–10% of the cavity space between its pair of adjacent teeth—positioned opposite from the first recess, on the first gear. As will be noted, such filling of these recesses may be accomplished in any desired manner, and may be simply done by the insertion of a molded strip between the pairs of adjacent teeth.

In referring to the construction of the Kaucic U.S. Pat. No. 4,657,060 arrangement, as an example, it will be seen that the filled recess of the invention is located between adjacent ones of the inwardly extending teeth on its annular ring, which prevents rotation of a pair of planetary gears which are oppositely positioned about the inside of the ring, and which are driven by the sprocket gear when rotated. In the Dickstein U.S. Pat. No. 4,834,163, on the other hand, the filled recess of the invention is between a pair of adjacent outwardly extending teeth on its annular ring as driven by the sprocket gear when rotated, to bind with a pair of planetary gears oppositely positioned about the outside of such ring. In both situations, the binding which results prevents any backwards rotation of the gears and the vanes beyond that point defining the closed position of the vanes—thereby preventing "bounceback".

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
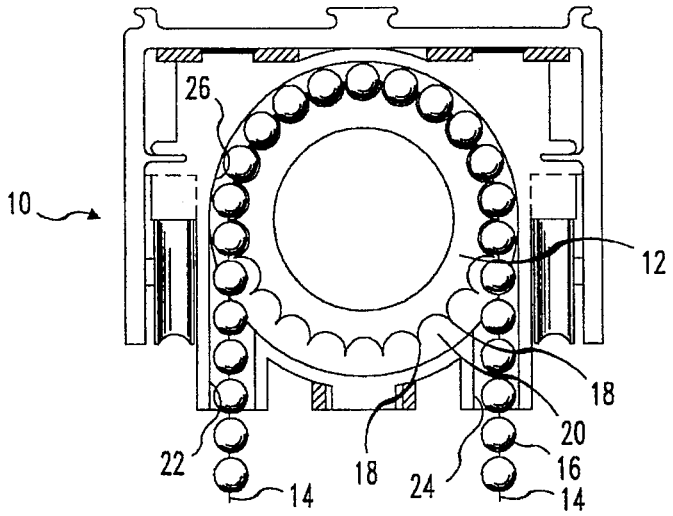
FIG. 1 PRIOR ART
FIGS. 1 and 2 are cut-away views of an end control housing of the type shown in U.S. Pat. No. 4,657,060.
Figure 2:
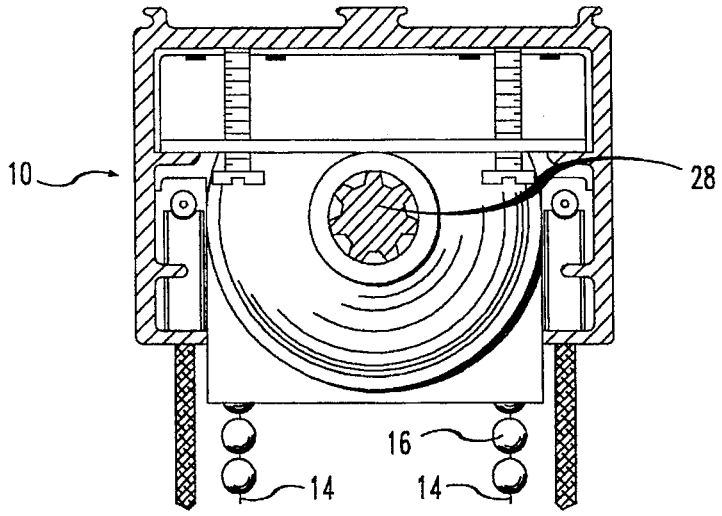
FIG. 2 PRIOR ART

In FIG. 1, the housing 10 shows a sprocket gear 12 and an endless flexible pull-chain 14 of bead actuators 16 of a dimension to seat between adjacent teeth 18 of the gear 12, i.e. in the cavity space recess 20. As shown, the bead actuators 16 are also of a dimension to fit within the openings 22, 24 of the housing 10, and between the recess 20 and the bearing wall 26 of the housing which surrounds the sprocket gear 12. As is described in U.S. Pat. No. 14,657,060, pulling on the flexible chain 14 rotates the sprocket gear 12 to rotate a fluted pinion gear and the vanes carried by it. Such fluted pinion gear is shown at reference numeral 28 in FIG. 2, which illustrates the reverse side of the configuration of FIG. 1.

Figure 3:
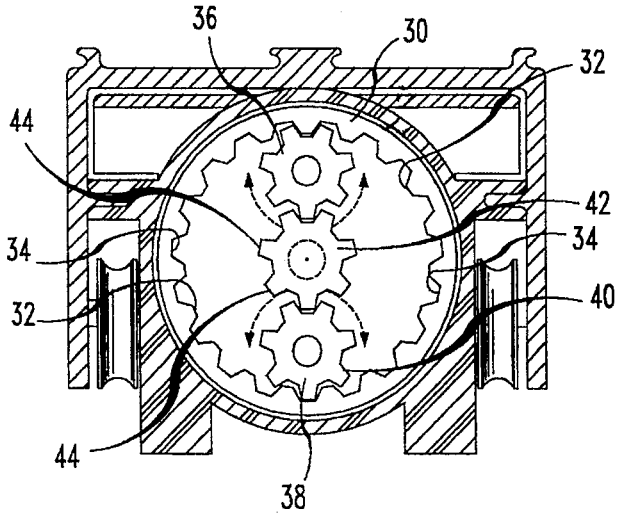
FIG. 3 PRIOR ART
FIGS. 3 and 4 are sectional views of the housing of FIGS. 1 and 2 for the positions where the louver vanes are "closed" and "opened", respectively.
Figure 4:
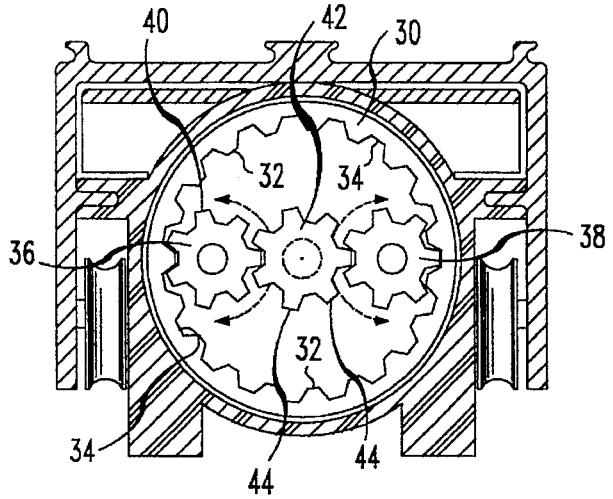
FIG. 4 PRIOR ART

FIG. 3 illustrates the end housing control of FIG. 1 with the sprocket gear 12 and the pull-chain 14 removed. In particular, and following the teachings of U.S. Pat. No. 4,657,060, FIG. 3 represents the end control housing as it would appear with the pullchain 14 and sprocket gear 12 actuated to rotate the vanes to a "closed" position. Conversely, FIG. 4 shows the same view with the pull chain 14 and sprocket gear 12 actuated to rotate the vanes to their "open" position. Each of FIGS. 3 and 4 show an annular ring gear 30 with inwardly extending teeth 32 separated by their own cavity space recesses 34. A pair of oppositely positioned planetary gears 36, 38 are spaced 180° away from each other along the ring gear 30, with their own teeth 40 arranged to intermesh with the teeth 32 of the ring gear 30, by fitting within the recesses 34. Reference numeral 42 identifies a sun gear which is conveniently molded integrally with the sprocket gear 12 and which extends coaxially from it to engage the planetary gears 36, 38 and having its own teeth 44 to mesh in the recesses between the teeth 40 in rotating the planetary gears 36, 38 about the annular ring gear. FIG. 3, in particular, represents the positions of the planetary gears 36, 38 with the vanes "closed", while the view of FIG. 4 represents the position of the planetary gears with the vanes "open". As will be appreciated, with the view of FIG. 4, the vanes are in the desired orientation for the vertical blind to be traversed.

Figure 5:
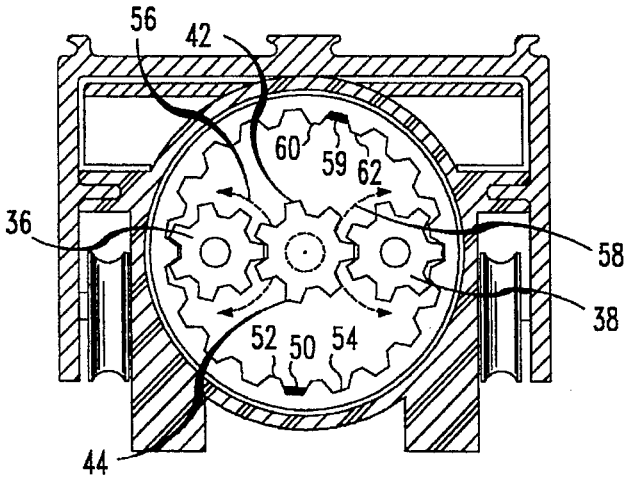
FIGS. 5, 6, 7 and 8 show different views of the end housing of FIGS. 3 and 4, helpful in an understanding of the invention.
Figure 6:
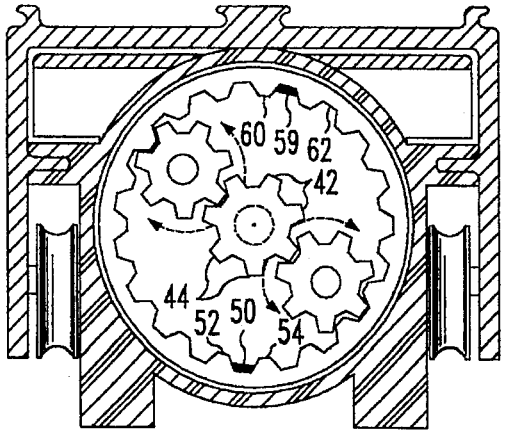
Figure 7:
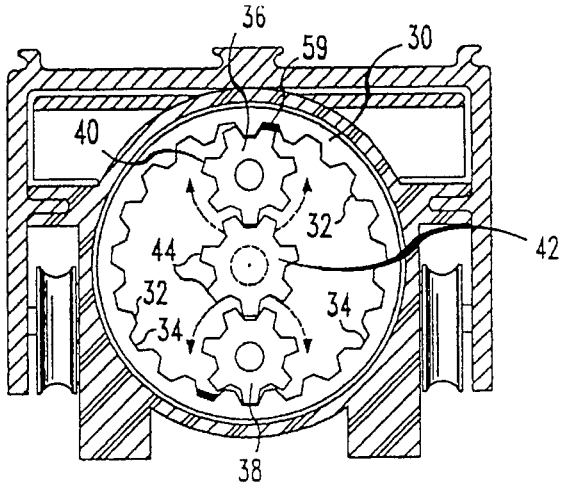

FIGS. 5–7 show the improvement of the present invention to the arrangement of Kaucic U.S. Pat. No. 4,657,060, by modifying a recess in the annular ring gear 30 at that point which corresponds to the "vane closed" position. More specifically, such recess is shown as 50 in FIGS. 5–7, and is constructed by filling in the cavity space to the extent of 5–10%, or greater. In one embodiment of the invention, such "filling-in" is accomplished with a molded strip between the adjacent teeth 52, 54. FIG. 5 shows the position of the planetary gears 36, 38 with the vanes "open", with the arrow notations 56, 58 indicating that the planetary gears 36, 38, can rotate clockwise, or counterclockwise about the inside of the annular ring gear 30. Such movement to rotate the vanes towards a "closed" position is depicted in FIG. 6, as accomplished by pulling on the chain 14 to actuate the sprocket gear 12, with FIG. 7 showing the position as "closed".

Figure 8:
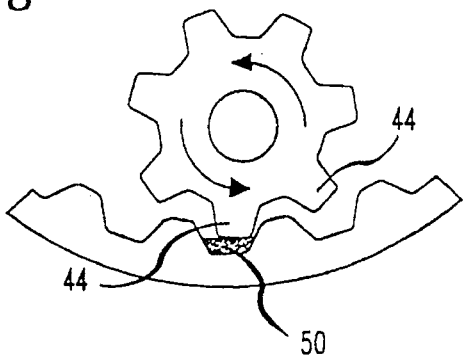

FIG. 8 is a detailed view showing the modified recess 50 and the adjacent teeth 52, 54, along with the teeth 44 on the planetary gear 38. As the pull-chain 14 is adjusted, the vanes are moved towards the "closed" position, until such time as the obstruction in the recess 50 is approached (just before full "vane closure"). Further pulling on the chain 14 by the user is sufficient to overcome the recess in closing the vane as the teeth 44 pass through into the recess—but once in such position, the obstruction prevents any forward or backward movement of an accidental nature, as by jostling into the pull-chain, or the vanes, or by a puff of breeze trying to open the vane. Simply stated, the amount of force just is not sufficient to overcome the obstruction in the filled recess. While testing has shown that only one such modified recess is sufficient to prevent this "bounceback", a second such recess is highly desirable, located on exactly an opposing point on the annular ring gear 30 so as to equalize the strain and reduce the wear and tear on the component parts of the mechanism—usually plastic gearing. Such second recess is shown at 59, between the adjacent teeth 60, 62. As with the recess 50, such second recess 59 need only be filled to at least 5–10% of the cavity space between the adjacent teeth.

Figure 9:
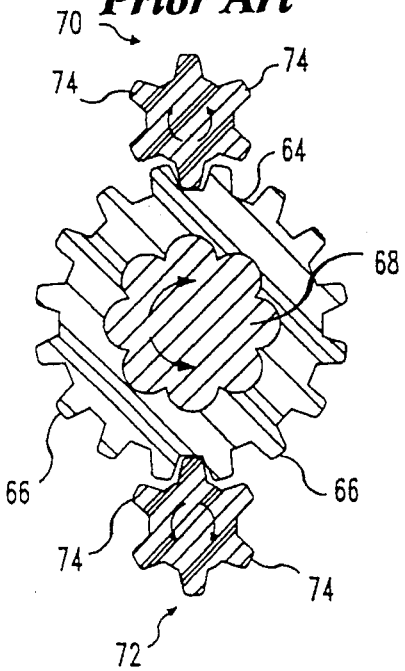
FIG. 9 Prior Art
FIG. 9 shows the gearing assembly of the end control housing of U.S. Pat. No. 4,834,163.
Figure 10:
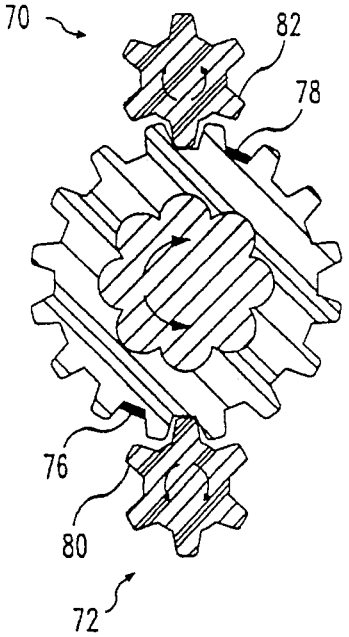
FIG. 10 illustrates the modification of the end control housing of FIG. 9 according to the teachings of the present invention.

FIG. 9, on the other hand, shows the type of end-control housing as is described in the Dickstein U.S. Pat. No. 4,834,163. In this arrangement, instead of an integrally molded annular ring gear 30 of inwardly extending teeth 32, this arrangement includes an annular ring gear 64 of outwardly extending teeth 66. The sprocket gear 12 in this situation is integrally mounted with a comparable gearing to seat within the interior socket 68 of the annular ring gear 64, and with the two planetary gears shown as 70, 72. As apparent, as the sprocket gear 12 rotates the interior socket 68 as the pull-chain 14 is actuated, the outwardly extending teeth 66 bear against the teeth 74 of the planetary gears 70, 72 in effectuating the rotation. With the teachings of the present invention, on the other hand, as shown in FIG. 10, a modified recess 76 is shown between two adjacent teeth on the annular ring gear 64, again filled at least 5–10% of the cavity space forming the recess. A second identical recess is shown at 78, 180° opposite the first recess 76, along the annular ring gear 64. As with the configuration of FIG. 8, sufficient force exerted on the pull-chain 14 to close the vanes brings the tooth 80 into the recess 76, and the tooth 82 into the recess 78, but once in such position to close the vane, any accidental jostling or puffs of breeze are insufficient in magnitude to overcome the recess and blockage in returning the planetary gears 70, 72 to a position to open the vane. Also, as with the arrangements of FIGS. 5–7, molded strips may be utilized to fill the recess 76, 78, as desired.

As will be readily appreciated by those skilled in the art, all that is required to carry out the teachings of the invention would be to re-tool the molds which produce the existing drive end controls, and can be accomplished quite inexpensively—for example, the tip of one or two teeth of one gear need only to be ground down an amount which turns out to be less than the thickness of this sheet of paper in actually carrying out the invention; likewise, the recess between the teeth can be filled as a part of the molding process for the gears themselves, or can be added after, if desired—in either case, the recess should optimally be filled of the same material composition as that of the gears to enhance their respective wearings. Both gear assemblies as shown in FIGS. 5–8 and 9–10 employ only two planetary gears as secondary supporting members, as the inclusion of any additional gears in such installation would allow binding of the mechanism at more than the two points of interest for each vane, resulting in restriction of the tilting action at points other than that where the vane is to be "closed", and is thus undesirable.

While there have been described what are considered to be preferred embodiments of the present invention, it will be readily understood that modifications can be made without departing from the scope of the teachings herein. For at least such reason, therefore, resort should be had to the claims appended hereto for a true understanding of the scope of the invention.

I claim:

1. In a vertical blind track of the type incorporating a sprocket gear within an end control housing to rotate a fluted pinion gear and vanes carried thereby under action of a pull-chain entrained around the sprocket gear, and with the end control housing including a first gear and a pair of second gears, one of which is driven by the sprocket gear when rotated, positive closure apparatus comprising:

a filled recess between a pair of adjacent teeth on said first gear to prevent meshing with at least one of said pair of second gears, said recess being filled at least 5–10% of the cavity space between said pair of adjacent teeth, and said recess being located on said first gear one position ahead of that recess location which defines the closed position of said vanes.

2. The positive closure apparatus of claim 1 wherein there is also included a second filled recess between a second pair of adjacent teeth on said first gear, oppositely positioned on said first gear with respect to said first filled recess, and wherein said second recess is filled at least 5–10% of the cavity space between said second pair of adjacent teeth.

3. The positive closure apparatus of claim 1 wherein said recess is filled by a molded strip between said pair of adjacent teeth.

4. The positive closure apparatus of claim 2 wherein said first and second recesses are filled by molded strips between said first and second pairs of adjacent teeth.

5. The positive closure apparatus of claim 1 in a vertical blind track of the type in which said end control housing includes a first gear in the form of an annular ring of inwardly extending adjacent teeth, and a pair of second gears in the form of a pair of planetary gears oppositely positioned about the inside of said annular ring and driven by the sprocket gear when rotated, and wherein said filled recess is between a pair of adjacent teeth on said annular ring.

6. The positive closure apparatus of claim 5 wherein there is also included a second filled recess between a second pair of adjacent teeth on said annular ring, positioned 180% away from said first recess along said annular ring.

7. The positive closure apparatus of claim 6 wherein said first and second recesses are filled by metallic strips between said first and second pairs of adjacent teeth.

8. The positive closure apparatus of claim 1 in a vertical blind track of the type in which said end control housing includes a first gear in the form of an annular ring of outwardly extending adjacent teeth driven by the sprocket gear when rotated, and a pair of second gears in the form of a pair of planetary gears oppositely positioned about the outside of said annular ring, and wherein said filled recess is between a pair of adjacent teeth on said annular ring.

9. The positive closure apparatus of claim 8 wherein there is also included a second filled recess between a second pair of adjacent teeth on said annular ring, positioned 180° away from said first recess along said annular ring.

10. The positive closure apparatus of claim 9 wherein said first and second recesses are filled by molded strips between said first and second pairs of adjacent teeth.

* * * * *